US006150646A

United States Patent [19]

Lai et al.

[11] Patent Number: 6,150,646

[45] Date of Patent: Nov. 21, 2000

[54] MICROWAVABLE CONTAINER HAVING ACTIVE MICROWAVE ENERGY HEATING ELEMENTS FOR COMBINED BULK AND SURFACE HEATING

[75] Inventors: Laurence Lai; Neilson Zeng, both of Ontario, Canada

[73] Assignee: Graphic Packaging Corporation, Golden, Colo.

[21] Appl. No.: 09/242,893

[22] PCT Filed: Aug. 26, 1997

[86] PCT No.: PCT/CA97/00600

§ 371 Date: Jun. 28, 1999

§ 102(e) Date: Jun. 28, 1999

[87] PCT Pub. No.: WO98/08750

PCT Pub. Date: Mar. 5, 1998

Related U.S. Application Data

[63] Continuation of application No. 08/703,100, Aug. 26, 1996, abandoned.

[51] Int. Cl.[7] ..... H05B 6/80

[52] U.S. Cl. ..... 219/728; 219/730; 219/759; 426/107; 426/243; 99/DIG. 14

[58] Field of Search ..... 219/728, 729, 219/735, 730, 734, 759; 426/107, 234, 243; 99/DIG. 14

[56] References Cited

U.S. PATENT DOCUMENTS

| | | | |
|---|---|---|---|
| 34,829 | 1/1995 | Stone . | |
| 3,835,280 | 9/1974 | Gades et al. | 219/728 |
| 4,320,274 | 3/1982 | Dehn | 219/728 |
| 4,656,325 | 4/1987 | Keefer | 219/728 |
| 4,703,148 | 10/1987 | Mikulski et al. | 219/730 |
| 4,814,568 | 3/1989 | Keefer . | |
| 4,866,232 | 9/1989 | Stone | 219/730 |
| 5,038,009 | 8/1991 | Babbitt . | |
| 5,117,078 | 5/1992 | Beckett | 219/728 |
| 5,126,518 | 6/1992 | Beckett | 219/734 |
| 5,260,537 | 11/1993 | Beckett . | |
| 5,310,980 | 5/1994 | Beckett | 219/728 |
| 5,322,984 | 6/1994 | Habeger, Jr. et al. | 219/728 |
| 5,354,973 | 10/1994 | Beckett | 219/730 |
| 5,391,864 | 2/1995 | Bodor et al. . | |
| 5,412,187 | 5/1995 | Walters et al. . | |
| 5,519,195 | 5/1996 | Keefer et al. . | |

FOREIGN PATENT DOCUMENTS

| | | |
|---|---|---|
| 0563999 | 10/1993 | European Pat. Off. . |
| WO89/04585 | 5/1989 | WIPO . |
| WO92/03358 | 3/1992 | WIPO . |
| WO97/11010 | 3/1997 | WIPO . |

*Primary Examiner*—Philip H. Leung
*Attorney, Agent, or Firm*—Dorsey & Whitney LLP

[57] ABSTRACT

A microwavable container includes an outer sleeve (12) and an inner tray (14) within the sleeve designed to carry a food product. A first active microwave energy heating element (28) is on the sleeve and disposed opposite the tray. A second active microwave energy heating element (74–102) is within the tray. The second microwave energy heating element has patterns of microwave energy interactive material on the bottom (60) and side walls (62) of the tray configured to permit a controlled degree of penetration of incident microwave energy through the bottom wall to channel microwave energy towards a central region of the tray and to promote browning of a food product carried by the tray about its periphery.

31 Claims, 14 Drawing Sheets

SAMPLE 1

1kg CHICKEN POT PIE
DATA SUMMARY SHEET

TEST #: 6
DATE: SEP-01

LID DESIGN: NONE
TRAY DESIGN: PROVIDED FOIL

MICROWAVE OVEN: CONVENTIONAL
COOK TIME (MINUTES): 75.00

| MOISTURE LOSS EVALUATION | | | |
|---|---|---|---|
| NET WT | INITIAL W | FINAL WT | % LOSS |
| 1015 | 1032 | 1020 | 1.2% |

| | TOP CRUST EVALUATION | | |
|---|---|---|---|
| | EDGE | MIDDLE | CENTRAL |
| % AREA | 0.33 | 0.33 | 0.34 |
| RATING | 5 | 4 | 4 |
| % A x R | 1.65 | 1.32 | 1.36 |
| TOTAL A x R | 4.33 | | |

RATING SCALE: 1 = SOGGY/MUSHY

| | MAX | MIN | RANGE | AVE | ST. DEV |
|---|---|---|---|---|---|
| CENTER | 140 | 138 | 2 | 139.3 | 1.2 |
| MIDDLE | 166 | 147 | 19 | 153.5 | 6.4 |
| PERIPHERA | 206 | 175 | 31 | 189.4 | 8.2 |
| OVERALL | 206 | 138 | 68 | 172.8 | 21.0 |

GENERAL COMMENTS:
TOP EDGES BURNT
PROCEDURE COMMENTS:

| | SIDE WALL EVALUATION | | |
|---|---|---|---|
| | TOP | MIDDLE | BOTTOM |
| % AREA | 0.33 | 0.33 | 0.34 |
| RATING | 5 | 4 | 4 |
| % A x R | 1.65 | 1.32 | 1.36 |
| TOTAL A x R | 4.33 | | |

2 = SOFT 3 = BARELY DRY 4 = DRY

| | BOTTOM CRUST EVALUATION | | |
|---|---|---|---|
| | EDGE | MIDDLE | CENTRAL |
| % AREA | 0.33 | 0.33 | 0.34 |
| RATING | 4 | 4 | 4 |
| % A x R | 1.32 | 1.32 | 1.38 |
| TOTAL A x R | 4 | | |

5 = DRY/FLAKY

| TEMPERATURE PROFILE (F) | | | | | | |
|---|---|---|---|---|---|---|
| 206 | 188 | 175 | 177 | 182 | 194 | 201 |
| 195 | 160 | 149 | 148 | 151 | 166 | 189 |
| 188 | 150 | 138 | 140 | 140 | 153 | 181 |
| 194 | 158 | 147 | 147 | 151 | 162 | 191 |
| 184 | 194 | 184 | 182 | 187 | 194 | 201 |

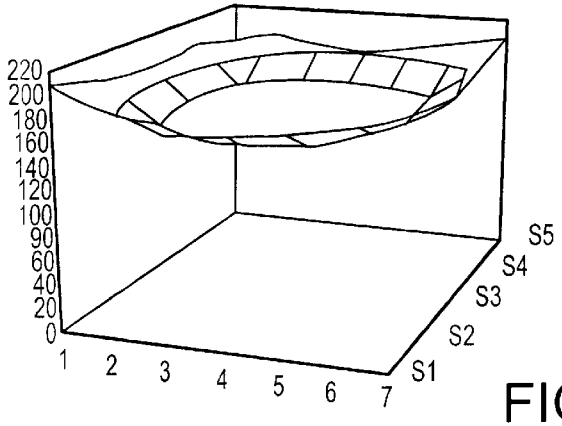

3D REPRESENTATION OF THE PIE INTERIOR TEMPERATURE PROFILE

FIG.11a

SAMPLE 2

1kg CHICKEN POT PIE
DATA SUMMARY SHEET

TEST #: 4
DATE: AUG-30

LID DESIGN: NONE
TRAY DESIGN: TRANSPARENT

MICROWAVE OVEN: 14
COOK TIME (MINUTES): 20.00

| MOISTURE LOSS EVALUATION | | | |
|---|---|---|---|
| NET WT | INITIAL W | FINAL WT | % LOSS |
| 974 | 1076 | 1019 | 5.8% |

| | TOP CRUST EVALUATION | | |
|---|---|---|---|
| | EDGE | MIDDLE | CENTRAL |
| % AREA | 0.33 | 0.33 | 0.34 |
| RATING | 4 | 2 | 1 |
| % A x R | 1.32 | 0.66 | 0.34 |
| TOTAL A x R | 2.32 | | |

RATING SCALE: 1 = SOGGY/MUSHY

| | MAX | MIN | RANGE | AVE | ST. DEV |
|---|---|---|---|---|---|
| CENTER | 110 | 64 | 46 | 92.7 | 25.0 |
| MIDDLE | 130 | 99 | 31 | 112.8 | 11.0 |
| PERIPHERA | 204 | 179 | 25 | 192.3 | 7.7 |
| OVERALL | 204 | 64 | 140 | 156.5 | 43.5 |

GENERAL COMMENTS:
BOTTOM REGION SOGGY
PROCEDURE COMMENTS:

| | SIDE WALL EVALUATION | | |
|---|---|---|---|
| | TOP | MIDDLE | BOTTOM |
| % AREA | 0.33 | 0.33 | 0.34 |
| RATING | 4 | 3 | 2 |
| % A x R | 1.32 | 0.99 | 0.68 |
| TOTAL A x R | 2.99 | | |

2 = SOFT 3 = BARELY DRY 4 = DRY

| | BOTTOM CRUST EVALUATION | | |
|---|---|---|---|
| | EDGE | MIDDLE | CENTRAL |
| % AREA | 0.33 | 0.33 | 0.34 |
| RATING | 2 | 2 | 2 |
| % A x R | 0.66 | 0.66 | 0.68 |
| TOTAL A x R | 2 | | |

5 = DRY/FLAKY

| TEMPERATURE PROFILE (F) | | | | | | |
|---|---|---|---|---|---|---|
| 204 | 189 | 179 | 183 | 182 | 185 | 189 |
| 202 | 118 | 125 | 100 | 109 | 130 | 204 |
| 195 | 99 | 104 | 64 | 110 | 116 | 200 |
| 196 | 108 | 99 | 105 | 126 | 119 | 196 |
| 201 | 186 | 184 | 190 | 191 | 189 | 199 |

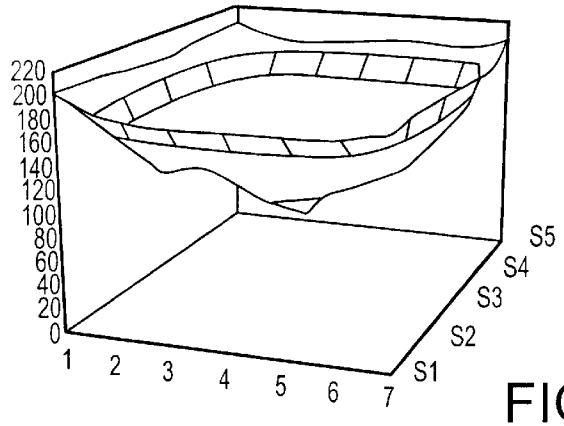

3D REPRESENTATION OF THE PIE INTERIOR TEMPERATURE PROFILE

FIG.11b

SAMPLE 3

1kg CHICKEN POT PIE
DATA SUMMARY SHEET

TEST #: 200
DATE: JAN-11

LID DESIGN: CLDC49.L10
TRAY DESIGN: COTTBOX54MM
CCTYWOB9.L11

MICROWAVE OVEN: 16
COOK TIME (MINUTES): 20.00

| MOISTURE LOSS EVALUATION | | | |
|---|---|---|---|
| NET WT | INITIAL W | FINAL WT | % LOSS |
| 959 | 1053 | 924 | 13.5% |

| | TOP CRUST EVALUATION | | |
|---|---|---|---|
| | EDGE | MIDDLE | CENTRAL |
| % AREA | 0.33 | 0.33 | 0.34 |
| RATING | 5 | 4.5 | 5 |
| % A x R | 1.65 | 1.485 | 1.7 |
| TOTAL A x R | 4.84 | | |

RATING SCALE: 1 = SOGGY/MUSHY

| | MAX | MIN | RANGE | AVE | ST. DEV |
|---|---|---|---|---|---|
| CENTER | 208 | 207 | 1.08 | 207.1 | 0.6 |
| MIDDLE | 210 | 206 | 4.14 | 208.0 | 1.2 |
| PERIPHERA | 209 | 198 | 11.49 | 203.8 | 2.8 |
| OVERALL | 209.75 | 197.5 | 12.24 | 205.6 | 3.0 |

GENERAL COMMENTS:
NOT A VERY FIT TIGHT WITH TRAY.
PROCEDURE COMMENTS:

| | SIDE WALL EVALUATION | | |
|---|---|---|---|
| | TOP | MIDDLE | BOTTOM |
| % AREA | 0.33 | 0.33 | 0.34 |
| RATING | 5 | 3.5 | 5 |
| % A x R | 1.65 | 1.155 | 1.7 |
| TOTAL A x R | 4.505 | | |

2 = SOFT 3 = BARELY DRY 4 = DRY

| | BOTTOM CRUST EVALUATION | | |
|---|---|---|---|
| | EDGE | MIDDLE | CENTRAL |
| % AREA | 0.33 | 0.33 | 0.34 |
| RATING | 4 | 4 | 3 |
| % A x R | 1.32 | 1.32 | 1.02 |
| TOTAL A x R | 3.66 | | |

5 = DRY/FLAKY

| TEMPERATURE PROFILE (F) | | | | | | |
|---|---|---|---|---|---|---|
| 202 | 201 | 203 | 203 | 201 | 203 | 198 |
| 206 | 207 | 208 | 208 | 208 | 207 | 205 |
| 207 | 209 | 207 | 207 | 208 | 207 | 205 |
| 207 | 209 | 207 | 206 | 210 | 209 | 206 |
| 202 | 204 | 202 | 205 | 209 | 207 | 202 |

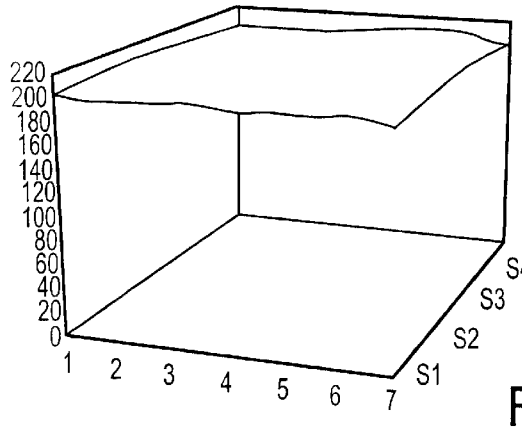

3D REPRESENTATION OF THE PIE INTERIOR TEMPERATURE PROFILE

FIG.11c

MICROWAVABLE CONTAINER HAVING ACTIVE MICROWAVE ENERGY HEATING ELEMENTS FOR COMBINED BULK AND SURFACE HEATING

CROSS-REFERENCE TO RELATED APPLICATIONS

This application is a national stage application submitted under 35 U.S.C. § 371 based upon International Application No. PCT/CA97/00600, filed Aug. 26, 1997 (the '600 application), which claims priority to U.S. utility application Ser. No. 08/703,100, filed Aug. 26, 1996 now abandoned (the '100 application) of which this is a continuation. The '600 and '100 applications are hereby incorporated by reference as though fully set forth herein.

FIELD OF THE INVENTION

The present invention relates to containers for food products and in particular to a microwavable container and to a tray for the same.

BACKGROUND OF THE INVENTION

Microwave ovens have become a principle form of cooking food in a rapid and effective manner and the number of food products available for preparation in a microwave oven is constantly increasing. As the market for microwavable food products has increased, so the sophistication required from such food products has also increased. There is, therefore, a continuing demand to improve the quality of food prepared in a microwave oven and to ensure that when it is presented to the consumer, the food is attractive and meets the standards normally associated with such food.

Foods that are specially prepared for cooking within a microwave oven are delivered to the consumer in containers that may be used directly within the microwave oven to facilitate preparation. These containers must therefore not only be capable of containing the food product during transport in an effective manner but must also be capable of contributing to the cooking of the food within the microwave oven and the subsequent presentation of the food.

As the demand for more sophisticated food products increases, so the demand for effects, particularly appearance, normally associated with food preparation also increases. For example, it is desirable for a food product that includes a pastry shell or lid to have a browned appearance, so that it appears to have been baked. While these effects can be produced in isolation, it becomes more difficult to produce such an effect in combination with a container that can also uniformly heat the food within a time that offers advantages over conventional cooking techniques.

Typically, the areas in which browning or crisping are required are those on the outer surfaces of the food product. Those areas typically receive the highest proportion of incident microwave radiation and therefore cook or heat the quickest. On the other hand, there are areas of the food product that are relatively shielded from incident microwave radiation or which exist in a region of a minimum RF field strength and which therefore require longer cooking periods. If, however, a longer cooking period is provided, the outer surfaces of the food product tend to char and burn, leading to an unacceptable food product.

Various attempts have been made in the past to provide containers that will produce effects normally associated with cooked foods. For example, U.S. Pat. No. 5,322,984 to Habeger, Jr. Et al. suggests a container having heating devices on the bottom wall and possibly the top wall of the container. The heating devices are designed to provide a charring effect normally associated with barbecuing by directing energy normally not incident upon the food product into specific regions. This is purported to produce a localised charring of the food product. Overall, however, such containers have not been successful. The charring effect produced on the food product may be attributed to the high field intensities and associated induced currents that result from the concentration of energy at particular locations. In practice it is found that those induced currents may also cause charring and burning of the container itself.

It has also been found that in order to produce the required results for the preparation of the food product, the container must be capable of controlling distribution of energy about the food product, to utilize the energy in the most efficient manner, and at the same time ensure that the food product and the container provide a pleasant and acceptable finished food product.

It is therefore an object of the present invention to provide a novel microwavable container, a tray for a microwavable container and a microwave energy heating insert.

SUMMARY OF THE INVENTION

According to one aspect of the present invention there is provided a microwavable container comprising:

an outer sleeve;

an inner tray within said sleeve and having a bottom wall and at least one upstanding side wall about the periphery of said bottom wall;

a first active microwave energy heating element within said sleeve and disposed opposite said tray; and a second active microwave energy heating element on said tray, said second microwave energy heating element having patterns of microwave energy interactive material on the bottom and side walls of said tray configured to permit a controlled degree of penetration of incident microwave energy through said bottom wall to channel microwave energy towards a central region of said tray and to promote browning of a food product carried by said tray about the periphery thereof.

In one embodiment, the microwave energy interactive material on the side walls has a plurality of slots formed therein. The slots adjacent the corners of the tray are curved upwardly to enhance browning of the food product in the corner regions of the tray. Preferably, opposed ends of at least some of the slots are bulbous to further enhance the heating effect by evening out the field strength along the length of the slots. A susceptor may be used to overlie the microwave energy interactive material on the bottom and side walls.

In one embodiment, the pattern of microwave energy interactive material on the bottom wall includes at least one and preferably a pair of large meandering loops. It is preferred that the length of the loops is approximately equal to an integer multiple of the effective wavelength of the incident microwave energy. It is also preferred that the pattern of microwave energy interactive material on the bottom wall further includes a ring about the peripheral edge of the bottom wall and wherein the meandering loops are open and are coupled to the ring by bridges.

Preferably, the first active microwave energy heating element includes a pattern of microwave energy interactive material having a ring about the periphery of the microwave energy heating element and defining a centrally located aperture. In one embodiment, an array of microwave energy interactive elements are located within the aperture. The microwave energy interactive elements can be in the form of circular or hexagonal islands. Alternatively, the microwave energy interactive elements can be in the form of loops with each of the loops surrounding an island.

According to another aspect of the present invention there is provided a tray of a microwavable container comprising:

a bottom wall;

at least one upstanding side wall about the periphery of said bottom wall; and an active microwave energy heating element within said tray, said active microwave energy heating element having patterns of microwave energy interactive material on the bottom and side walls of said tray configured to permit a controlled degree of penetration of incident microwave energy through said bottom wall to channel microwave energy towards a central region of said tray and to promote browning of a food product carried by said tray about the periphery thereof.

According to still yet another aspect of the present invention there is provided an active microwave energy heating insert to be placed under a microwavable container comprising:

a substrate; and an active microwave energy heating element on said substrate, said active microwave energy heating element including a pattern of microwave energy interactive material thereon configured to permit a controlled degree of penetration of incident microwave energy therethrough to channel microwave energy towards a central region of a microwavable container thereon.

The present invention provides advantages in that the microwavable container design is such to heat generally uniformly a food product while browning and drying the outer periphery of the food product in one package. This design is particularly suited to cooking pies and other similar products having a crust.

BRIEF DESCRIPTION OF THE DRAWINGS

Embodiments of the present invention will now be described more fully with reference to the accompanying drawings in which:

FIGS. 11*a* to 11*c* are graphs showing three-dimensional surface temperature profiles of food products cooked in a conventional oven and in a microwave oven and supported by a number of microwavable containers including the microwavable container of FIG. 1.

DETAILED DESCRIPTION OF THE PREFERRED EMBODIMENT

Figure 1:
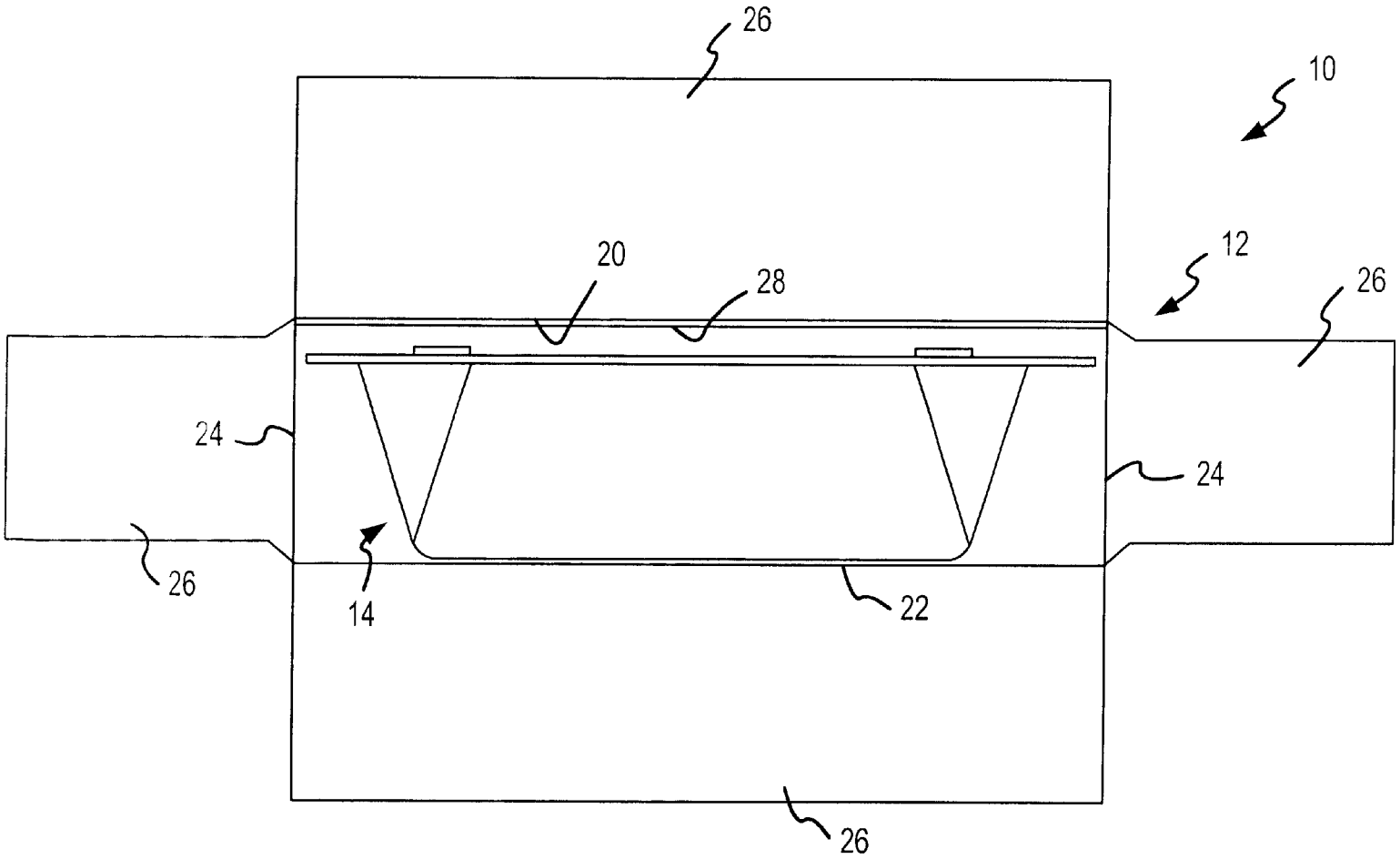
FIG. 1 is a side elevational view of a microwavable container in accordance with the present invention.

Referring now to FIGS. 1 to 5, and embodiment of a microwavable container is shown and is generally indicated to by reference numeral 10. The container 10 includes a generally rectangular outer carton 12 and an inner tray 14 arranged to carry a food product preferably in the form of a pie having a crust. The carton 12 is folded from a paperboard blank and has top and bottom major panels 20, 22, interconnected by side panels 24. Side flaps 26 extend about the edges of the major panels 20, 22 and about the side panels 24. The side flaps 26 can be folded to seal the carton 12. The exact details of the carton and paperboard blank will vary according to the food product dimensions and characteristics of the carton and are provided for illustrative purposes only.

Figure 2:
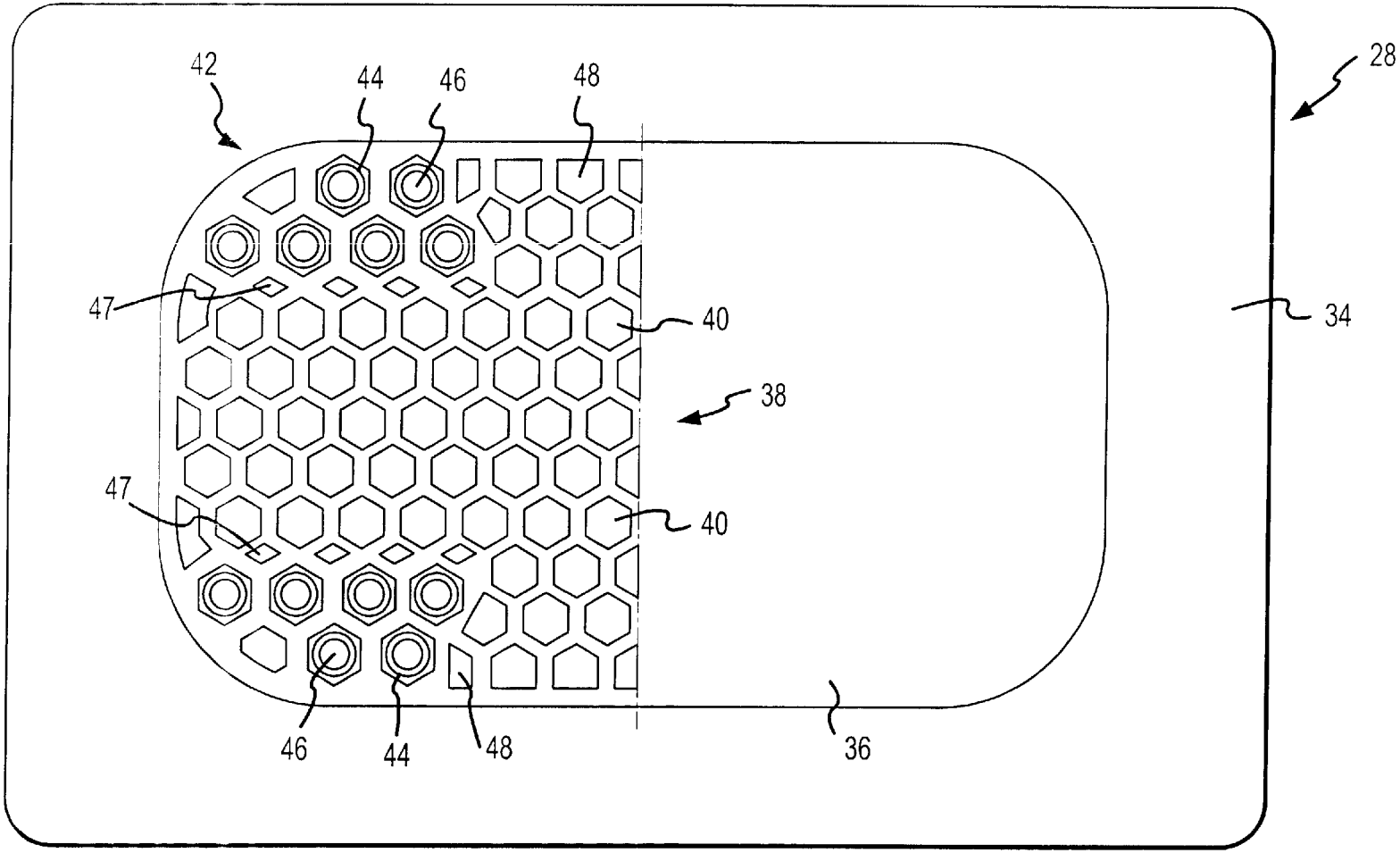
FIG. 2 is a plan view of an active microwave energy heating element forming part of the microwavable container of FIG. 1.
Figure 3:
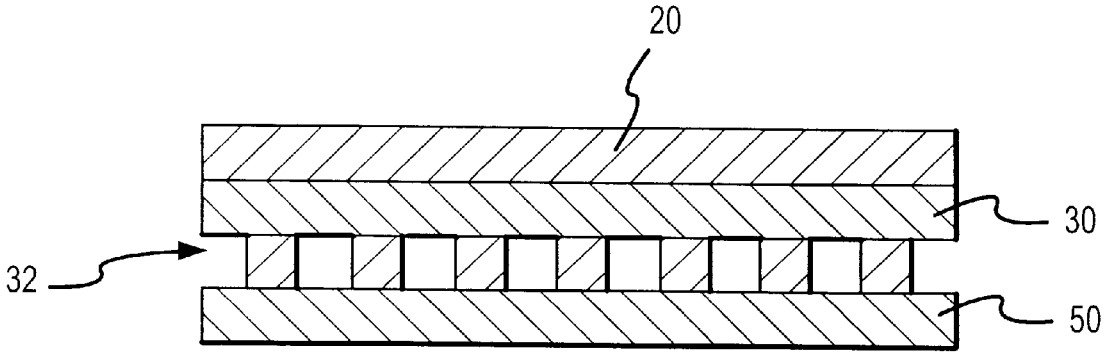
FIG. 3 is a cross-sectional view of a portion of the microwavable container of FIG. 1.

The top major panel 20 of the carton 12 supports an active microwave energy heating element 28 best seen in FIGS. 2 and 3. The active microwave energy heating element 28 is bonded or adhered to the inwardly directed face of the top panel 20 so that the active microwave energy heating element 28 overlies the inner tray 14 when the tray is inserted into the carton 12.

The active microwave energy heating element 28 includes a substrate 30 formed of suitable material such as for example, polymeric film, paper or paperboard. A pattern 32 of microwave energy interactive material is disposed on the substrate 30. The microwave energy interactive material may be electroconductive or semiconductive material such as for example metal foil, vacuum deposited metal or metallic ink. In the case of electroconductive material, aluminum is preferred although other metals such as copper may be employed. In addition, the electroconductive material maybe replaced with a suitable electroconductive, semiconductive or non-conductive artificial dielectric or ferroelectric. Artificial dielectrics comprise conductive subdivided material in a polymeric or other suitable matrix or binder and may include flakes of electroconductive metal such as aluminum. Alternatively, the microwave energy interactive material may be in the form of a patterned susceptor including one or more layers of suscepting material. In the present embodiment, the microwave energy interactive material is in the form of metal foil.

As best illustrated in FIG. 2, the pattern of microwave energy interactive material includes an outer thick ring 34 defining a central aperture 36. Within the aperture 36 is an array 38 of islands 40. For the most part, the islands 40 in the array 38 are generally hexagonal in shape although near the corners and along the sides of the array, the islands 40 take different shapes. Specifically, in the present example, at each corner of the array 38, is a group 42 of hexagonal rings 44 surrounding circular islands 46. The hexagonal rings 44 are arranged in two small rows and are surrounded along one side by smaller islands 47 shaped to fill in the spaces between the hexagonal rings 44 and the hexagonal islands 40. Partial hexagonal islands 48 are positioned along the sides of the array where there is insufficient room for complete hexagonal islands.

A susceptor 50 including at least one layer of suscepting material overlies the microwave energy interactive material and substrate 30. The susceptor 50 produces a heating effect upon excitation by incident microwave energy as is well known. The susceptor may be in the form of a printed ink or alternatively a coating sputtered or evaporated over the substrate 30 and microwave energy interactive material. Susceptor 50 may not be utilized or additional layers of suscepting material may be provided depending upon the heating effect required. If the susceptor 50 is not used, a plain polymeric film will typically be used in its place.

As a principal form of control, the rings and islands are reactive with the incident microwave energy so that their nature and the extent of their coverage of the top panel 20 of the carton 12 determines the amount and distribution of energy transmitted to the upper surface of the food product carried by the inner tray 14. The islands principally prevent transmission of microwave energy but they also provide a local excitation at their outer edges. Therefore, the islands enhance the excitation of the susceptor to increase its effect. The spacing between the islands and rings and their sizes are selected to control the transmission and distribution of energy to the food product to avoid charring of the food product while ensuring the upper surface of the food product is browned as desired.

Figure 4:
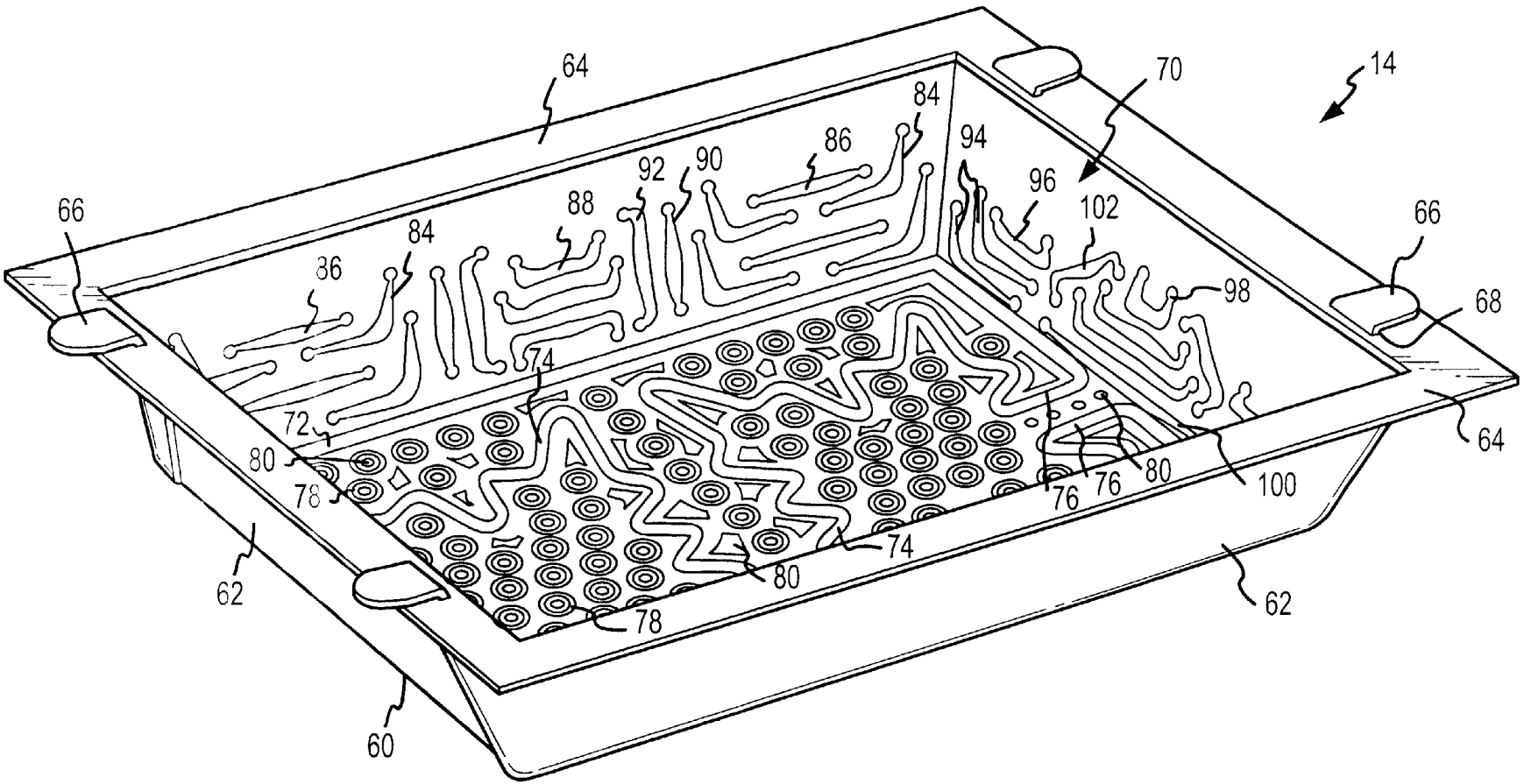
FIG. 4 is a perspective view of a tray forming part of the microwavable container of FIG. 1.

Referring now to FIG. 4, the inner tray 14 is better illustrated. As can be seen, similar techniques to those used with respect to the active microwave energy heating element 28 on the outer carton 12 are used on the inner tray. Inner tray 14 includes a bottom wall 60 and upstanding major and minor side walls 62 about the periphery of the bottom wall. The side walls 62 terminate in an outwardly extending rim 64. Tabs 66 extend from the side walls 62 through apertures 68 in the rim 64 and are folded and bonded to the rim 64 to enhance the structural integrity of the inner tray 14. The inner tray 14 in this example is constructed from a paperboard blank best seen in FIG. 5 although it should be realized that the tray may be press-formed.

An active microwave energy heating element 70 is bonded or adhered to the interior surfaces of the bottom and side walls 60 and 62 respectively. Similar to the active microwave energy heating element 28, active microwave energy heating element 70 is in the form of a laminate including a substrate on which a pattern of microwave energy interactive material is disposed. A susceptor including at least one layer of suscepting material overlies the pattern of microwave energy interactive material and the substrate so that the susceptor is positioned between the active microwave energy heating element 70 and a food product carried by the inner tray 14. The susceptor may not be utilized or additional layers of suscepting material may be provided depending upon the heating effect required. If the susceptor is not used, a plain polymeric film will typically be used in its place.

In this particular example, the pattern of microwave energy interactive material on the bottom wall includes a generally rectangular ring 72 about the peripheral margin of the bottom wall. Within the rectangular ring 72 are two large meandering open loops 74 which generally resemble maple leaves. The meandering loops 74 are coupled to the rectangular ring 72 by a pair of bridges 76. The length of each meandering loop 74 is preferably close to an integer multiple of the wavelength of the incident microwave energy. In this specific example, each meandering loop has a length which is equal to approximately $5\lambda$ where $\lambda$ is the effective wavelength of the incident microwave energy projected onto the surface of the active microwave energy heating element 70. By using large multi-wavelength meandering loops and providing tight bends in the loops, which may be used to increase localized capacitance, better and more uniform heating of a central region of the food product is achieved.

Surrounding the meandering loops 74 on both the inside and the outside thereof are a plurality of loops 78 and islands 80. The loops 78 are in the form of annular rings surrounding smaller circular islands. The islands 80 are provided at various locations and are shaped to conform with surrounding islands or loops so that a generally even spacing between adjacent islands and loops exists.

The sizes of the loops and islands are chosen to achieve the desired cooking result. For example, the sizes of the loops and islands may be selected to be sufficiently small so that the loops 78 and islands 80 are decoupled from the large meandering loops 74 and therefore, contribute very little to the heating effect produced by the active microwave energy heating element 70. Alternatively, the sizes of the loops and islands may be selected to be sufficiently large to contribute to the heating effect.

The inner surface of each side wall 62 is also coated with microwave energy interactive material. A plurality of spaced elongate slots 82 (FIG. 5) are formed in the microwave energy interactive material on each side wall. The elongate slots are sized and shaped to promote localized fields adjacent thereto and enhance excitation of the susceptor to promote browning of the food product held by the inner tray when exposed to incident microwave energy.

The arrangement of the slots 82 formed in the pattern of microwave energy interactive material on each major side wall is the same. As can be seen, at the end of each major side wall 62 are two pair of laterally spaced curved slots 84 arranged to form a generally U-shaped configuration. Between each U-shaped configuration is a generally horizontal slot 86 having cambered major edges. Centrally located on each major side wall is another configuration of slots. This configuration includes a stack of vertically spaced, generally U-shaped slots 88. The bottom slot in the stack is inverted. On each side of the stack is a pair of laterally spaced, generally upright slots 90 and 92. Both slots have cambered major edges. The interior slots 92 have inturned ends. Each of the slots formed in the microwave interactive material has bulbous ends to even out the field strength along the lengths of the slots.

The arrangement of the slots 82 formed in the microwave energy interactive material on each minor side wall 62 is the same but the patterns are different than those on the major side walls. At the end of each minor side wall is a pair of vertically spaced curved slots 94, each having bulbous ends. Above the pair is a generally horizontal slot 96 having one upright end and an opposite gradually curved end. Centrally located on each minor side wall is a stack of vertically spaced, generally U-shaped slots 98. The bottom two slots in the stack are shallow and have bulbous ends. The stack of slots is positioned above a generally horizontal slot 100 having cambered major sides and bulbous ends. On each side of the stack is an angled slot 102 having downturned ends that are bulbous.

The slots formed in the microwave energy interactive material adjacent the corners of the inner tray 14 curve upwardly to enhance browning of the food product adjacent the corner regions of the inner tray. The bulbous ends of the majority of the slots further assist in the heating effect. Although a particular arrangement of slots has been shown, those of skill in the art will appreciate that other various arrangements can be used depending on the heating effect desired.

Figure 5:
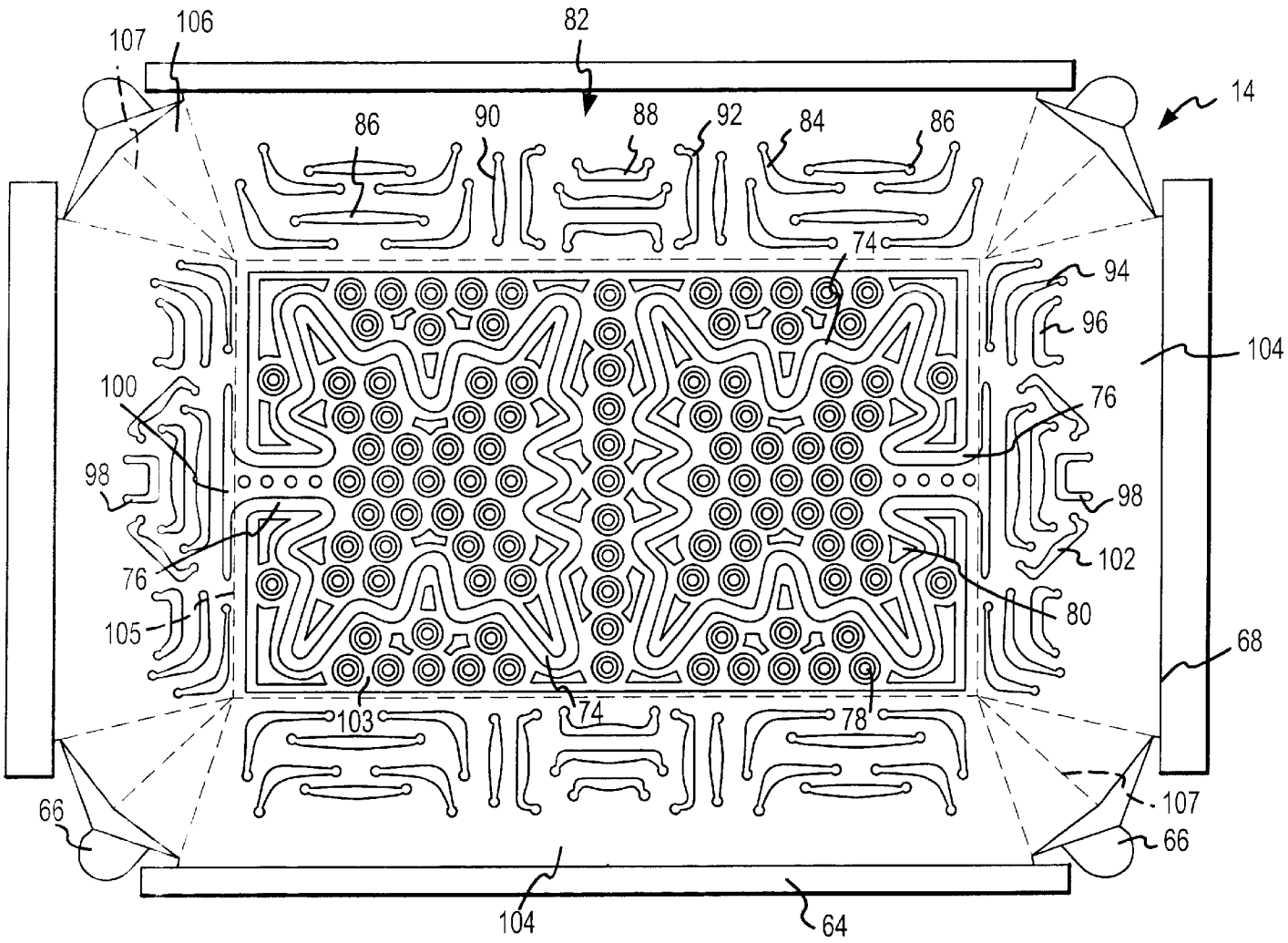
FIG. 5 is a top plan view of a blank which can be constructed to form the tray of FIG. 4.

Referring now to FIG. 5, the blank used to construct the inner tray 14 is better illustrated. The blank includes a generally rectangular central panel 103 constituting the bottom wall and four generally rectangular peripheral panels 104 joined to a respective edge of the central panel by score lines 105. The peripheral panels 104 constitute the side walls of the inner tray. Intermediate panels 106 bridge the peripheral panels at the corners of the blank and have bisecting score lines 107 thereon. A tab 66 is formed along the outer edge of each intermediate panel.

When the inner tray 14 is to be constructed from the blank, the rectangular panels 104 are folded upwardly about the score lines 105. The bisecting score lines 107 and the intermediate panels 106 are folded in a direction away from the interior of the inner tray 14. The intermediate panels 106 are then folded to overlie a side wall so that the tabs 66 can pass through the apertures 68 in the rim 64. The tabs are then be folded to overlie the rim.

Figure 6:
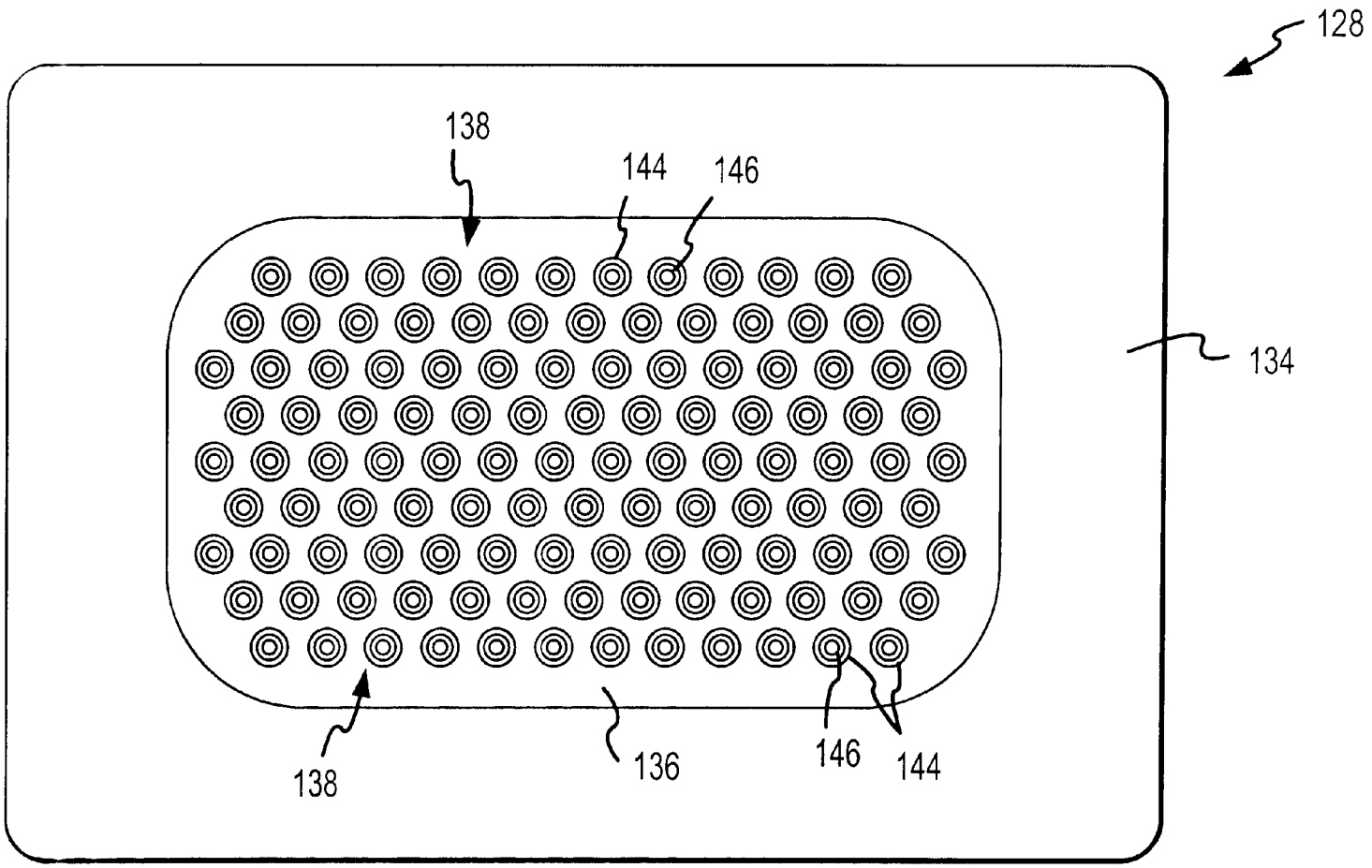
FIG. 6 is a plan view of an alternative embodiment of an active microwave energy heating element for the microwavable container of FIG. 1.

Referring to FIG. 6, another embodiment of an active microwavable heating element to be supported on the inwardly directed surface of the top major panel 20 of the inner carton 12 and to overlie the inner tray 14 is shown. In this embodiment, like reference numerals will be used to indicated like components of the previous embodiment with a "100" added for clarity. Similar to the active microwave energy heating element 28, active microwave energy heating element 128 includes a pattern of microwave energy interactive material disposed on a substrate. A susceptor including at least one layer of suscepting material overlying the microwave energy interactive material and the substrate may be utilized. If the susceptor is not used, a plain polymeric film will typically be used in its place. The pattern of microwave energy interactive material includes an outer thick ring 134 defining a central aperture 136. Within the aperture 136 is an array 138 of loops 144. Each loop 144 is in the form of a circular ring surrounding a circular island 146.

Figure 7:
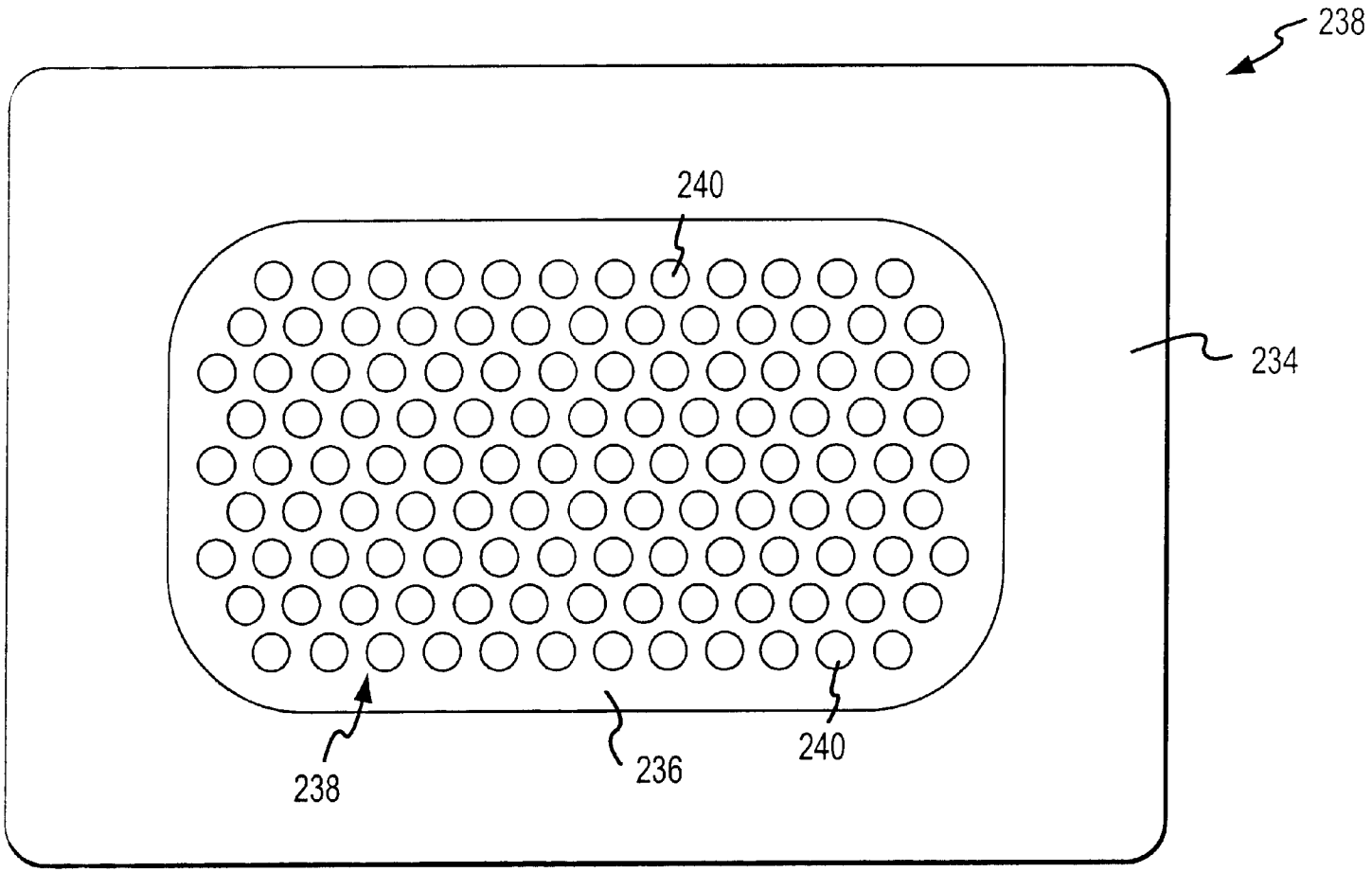
FIG. 7 is a plan view of yet another embodiment of an active microwave energy heating element for the microwavable container of FIG. 1.

Referring now to FIG. 7, yet another embodiment of an active microwave heating element to be supported on the inwardly directed surface of the top major panel 20 of the inner carton 12 and to overlie the inner tray 14 is shown. In this embodiment, like reference numerals will be used to indicate like components of the first embodiment with a "200" added for clarity. As can be seen, the pattern of microwave energy interactive material includes an outer thick ring 234 defining a central aperture 236. Within the aperture 236 is an array 238 of circular islands 240. A susceptor including at least one layer of suscepting material overlying the microwave energy interactive material and the substrate may be utilized. If the susceptor is not used, a plain polymeric film will typically be used in its place.

Figure 8:
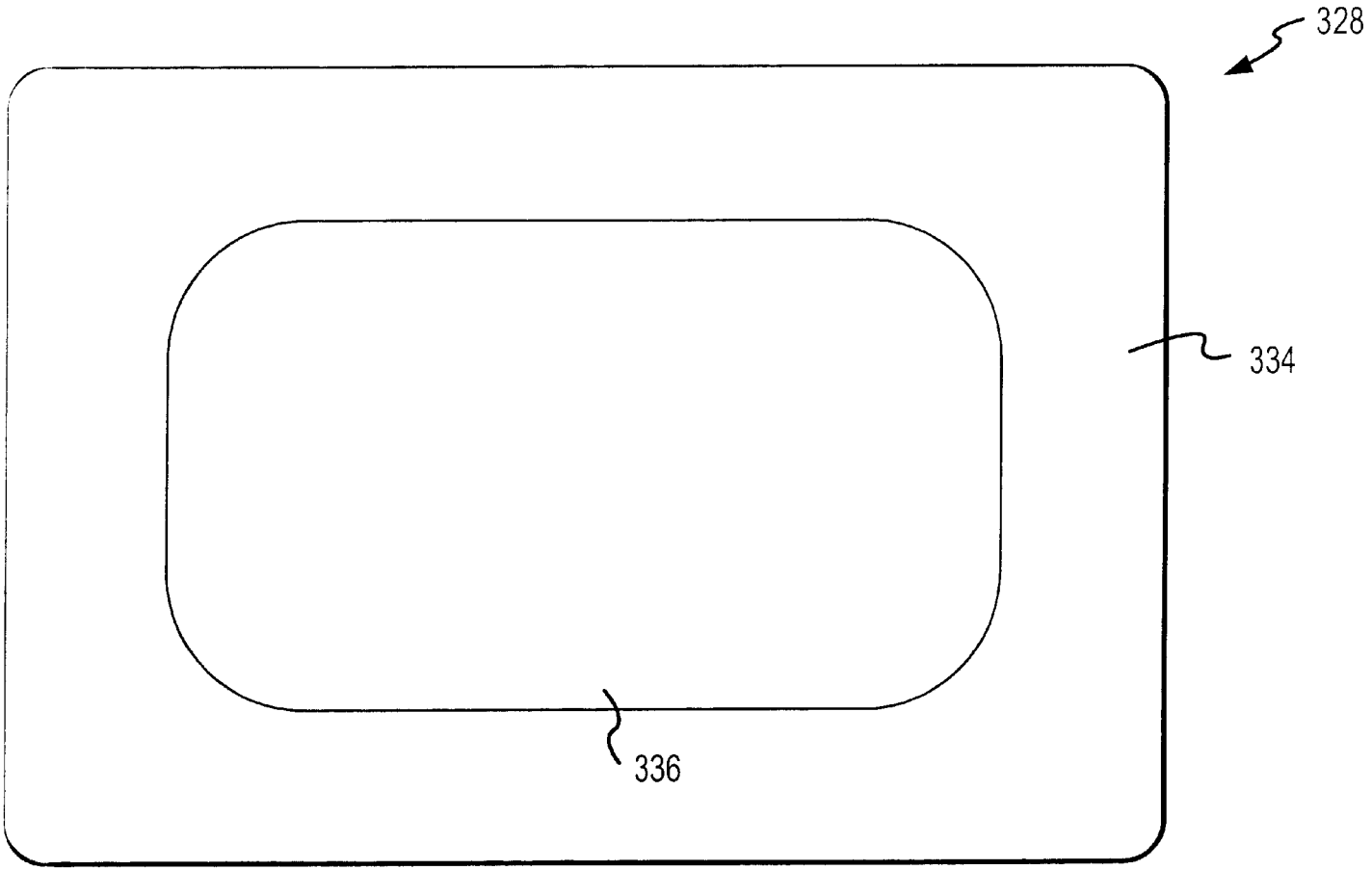
FIG. 8 is a plan view of still yet another embodiment of an active microwave energy heating element for the microwavable container of FIG. 1.

Referring now to FIG. 8, still yet another embodiment of an active microwave energy heating element 328 to be supported on the inwardly directed surface of the top major panel 20 of the inner carton 12 and to overlie the inner tray 14 is shown. In this embodiment, like reference numerals will be used to indicate like components of the first embodiment with a "300" added for clarity. As can be seen, the pattern of microwave energy interactive material includes an outer thick rectangular ring 334 defining a central aperture 336. A susceptor including at least one layer of suscepting material overlying the microwave energy interactive material and the substrate may be utilized.

Figure 9:
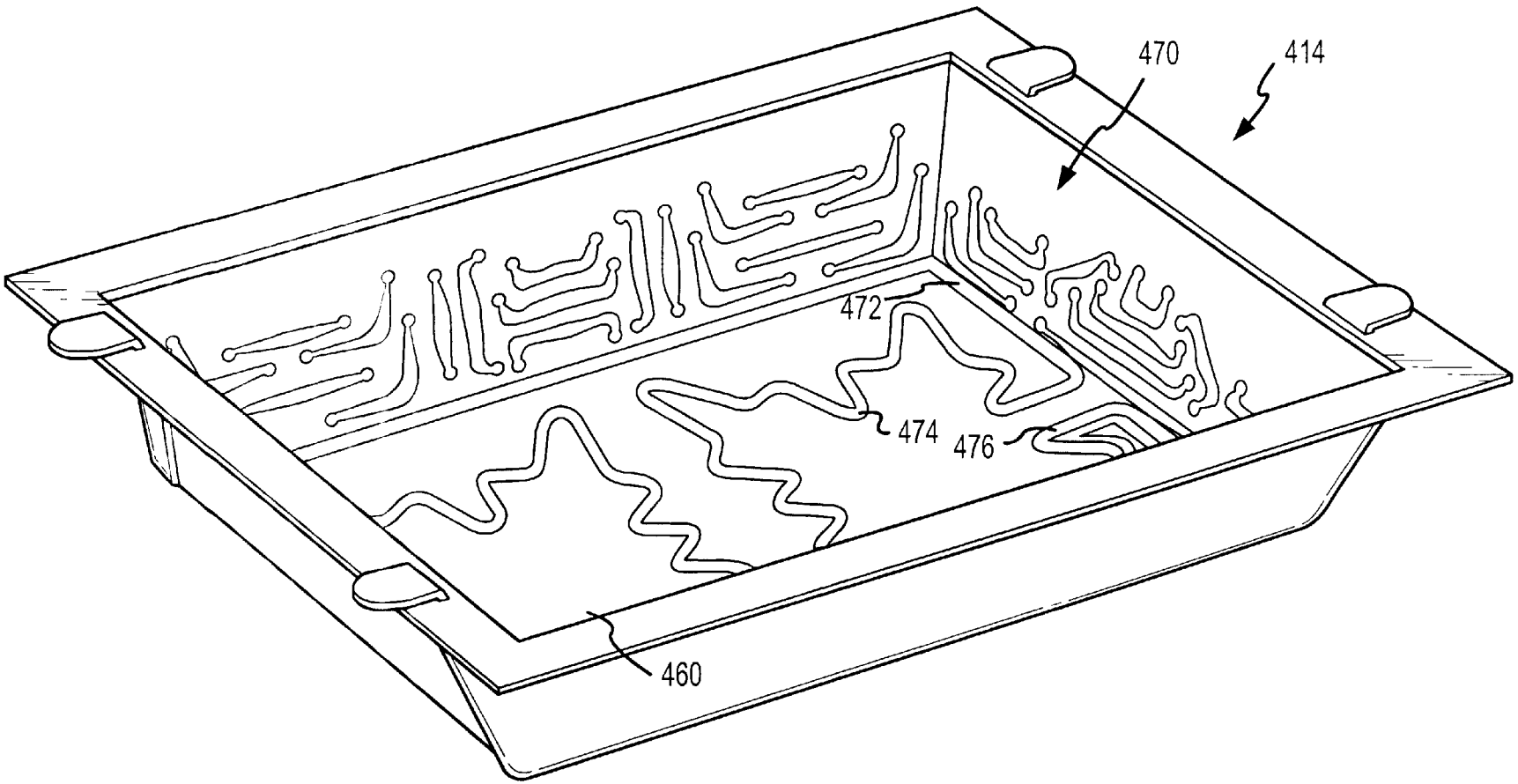
FIG. 9 is a perspective view of another embodiment of a tray for the microwavable container of FIG. 1.

Referring now to FIG. 9, another embodiment of an inner tray 414 very similar to that of the first embodiment is shown. In this embodiment, like reference numerals will be used to indicate like components of the first embodiment with a "400" added for clarity.

As can be seen, the active microwave energy heating element 470 is very similar to that of the first embodiment. However, unlike the first embodiment, the pattern of microwave energy interactive material on the bottom wall 460 only includes a rectangular ring 472 and two large meandering open loops 474 coupled to the ring 472 by bridges 476. In this embodiment, the loops 78 and islands 80 (FIG. 4) are removed from the substrate.

Figure 10:
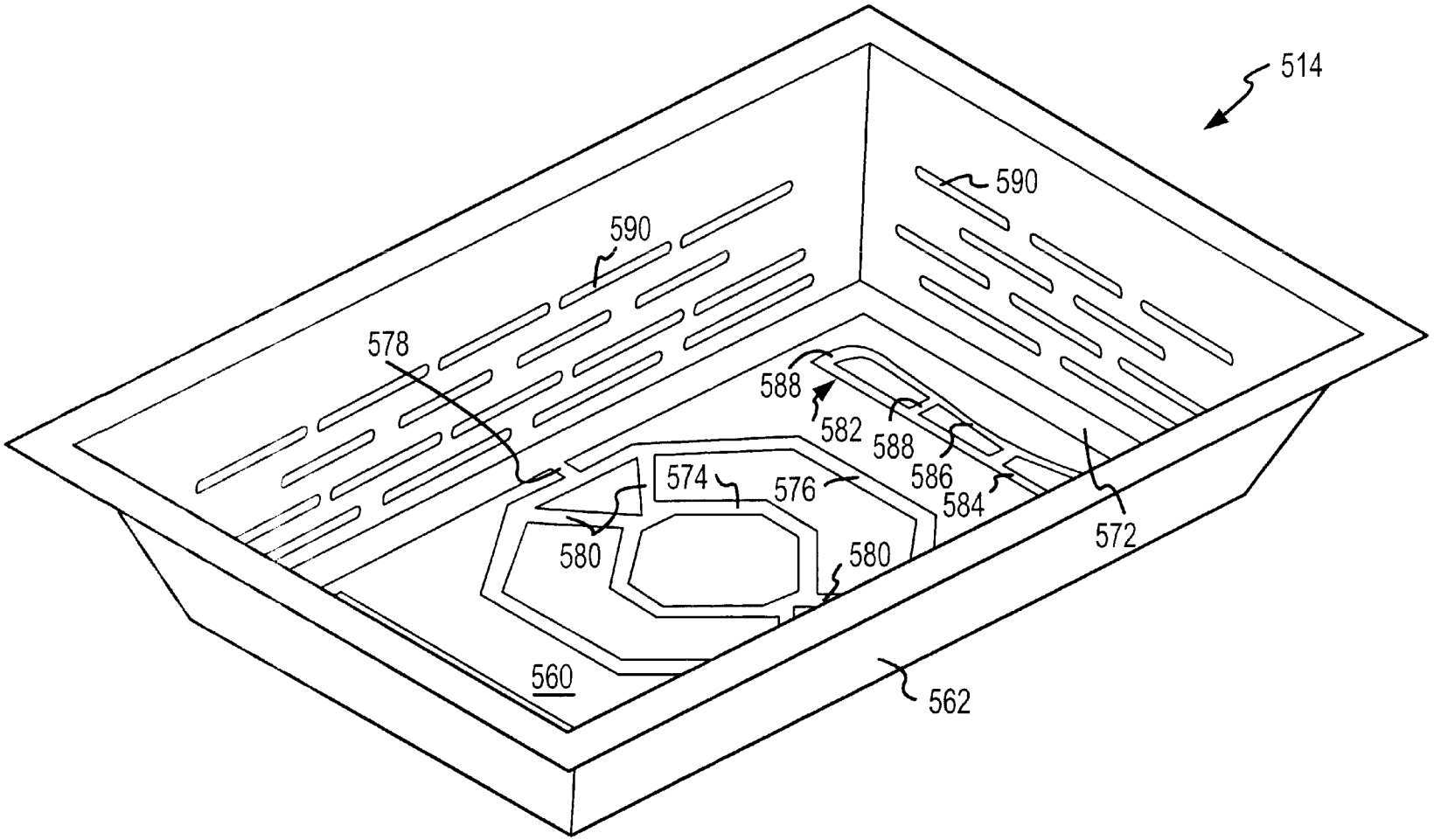
FIG. 10 is a perspective view of yet another embodiment of a tray for the microwavable container of FIG. 1.

Referring now to FIG. 10, still yet another embodiment of an inner tray 514 is shown. Similar to the previous embodiments, an active microwave energy heating element is bonded or adhered to the interior surfaces of the bottom and side walls 560 and 562 respectively. As can be seen, the pattern of microwave energy interactive material on the bottom wall 560 includes a rectangular ring 572 positioned about the peripheral margin of the bottom wall. Two concentric octagonal rings 574 and 576 respectively are centrally positioned on the bottom wall. The outer octagonal ring 576 is joined to the rectangular ring 572 by a pair of bridges 578. The inner octagonal ring 574 is joined to the outer octagonal ring 576 by two pair of diverging bridges 580.

Generally rectangular rings 582 are positioned adjacent opposed ends of the bottom wall and are spaced slightly from the rectangular ring 572. Each ring 582 has a major transverse leg 584 and a major generally concave leg 586. The two major legs are joined by a plurality of spaced bridges 588.

A plurality of spaced elongate slots 590 are formed in the microwave energy interactive material on each side wall 562. The elongate slots are arranged in staggard rows with the slots in the row nearest the bottom wall being more elongate than those in other rows. The elongate slots are sized to promote localized fields to enhance the susceptor and promote browning of the food product held by the container when penetrated by microwave energy.

In the embodiments described above, the microwavable container is described as having an active microwave energy heating element bonded or adhered to the outer container to overlie the tray. Those of skill in the art will appreciate that the active microwave energy heating on the top major panel may be free-floating and inserted into the carton 12 and rest on the tray 14 above the food product. It also should however be appreciated that the trays may be used alone with or without a lid. If a lid is to be included, the lid may also be in the form of a polymeric film, metal foil or a susceptor. It should also be appreciated that although the described embodiments show the pattern of microwave energy interactive material being covered with a susceptor, the susceptor is optional.

Figure 12:
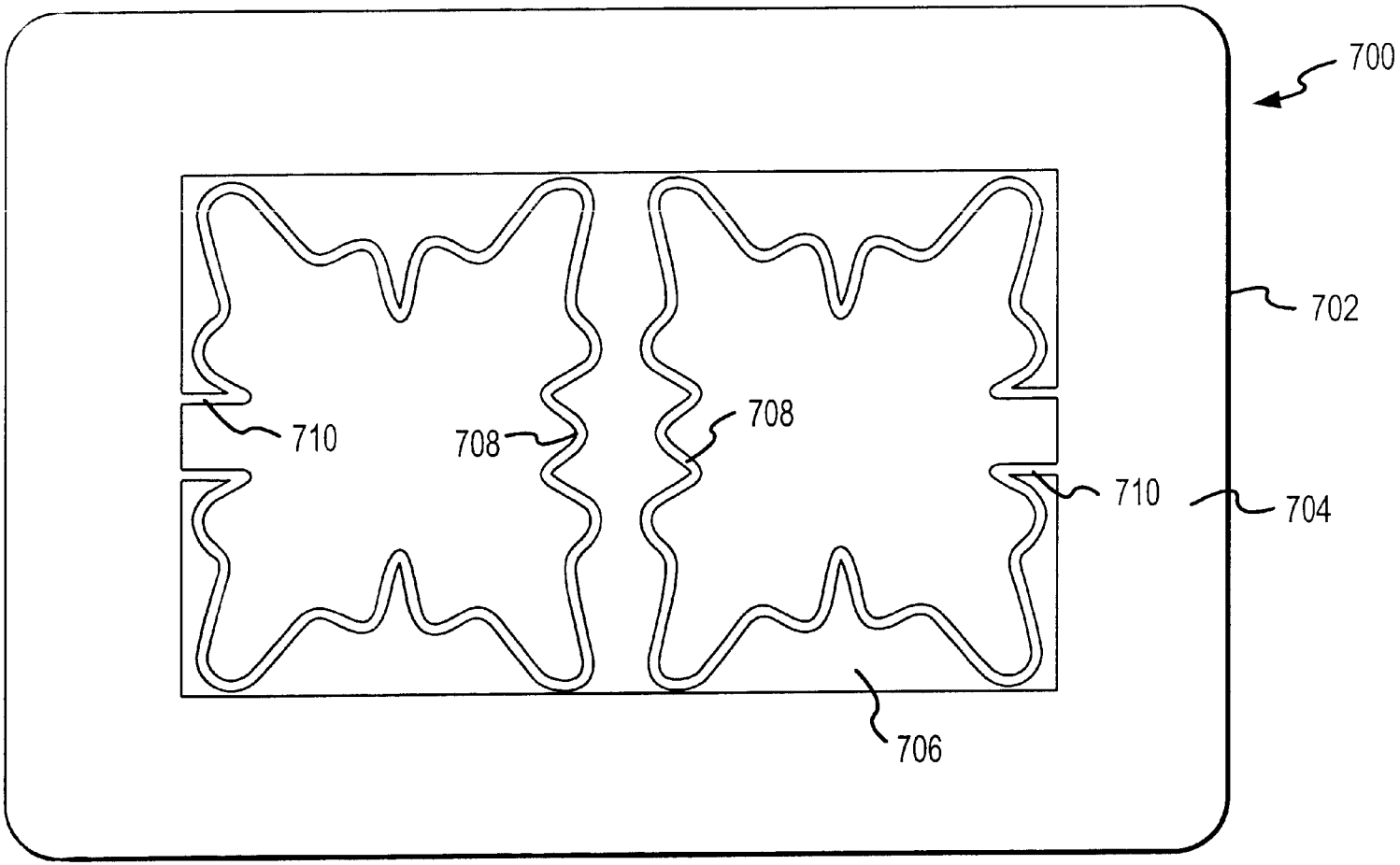
FIG. 12 is a top plan view of an active microwave energy heating insert in accordance with the present invention.

Referring now to FIG. 12, an active microwave energy heating insert is shown and is generally indicated to by reference numeral 700. The insert 700 includes a paperboard substrate 702 on which an active microwave energy heating element is bonded or adhered. The active microwave energy heating element includes a pattern of microwave energy interactive material which may or may not be covered with a susceptor. The pattern of microwave energy interactive material is similar to that on the bottom wall of the tray illustrated in FIG. 9. Specifically, the pattern of microwave energy interactive material includes a thick generally rectangular ring 704 about the peripheral margin of the insert defining a central aperture 706. Within the aperture are two large meandering open loops 708. The open loops 708 are coupled to the rectangular ring by bridges 710. The insert 700 is designed to be placed under a conventional microwavable container to enhance the heating effect so that the food product in the conventional microwavable container is more uniformly heated when cooked.

Although the embodiments of FIGS. 4, 9 and 12 show an active microwave energy heating element including a pair of large meandering loops, it should be apparent to those of skill in the art that one large meandering loop or more than two meandering loops may be utilized depending on the heating effect desired.

EXAMPLE

This Example illustrates the beneficial effect obtained using the microwavable container 10 of the present invention.

A 1 kg chicken pot pie was placed in a foil container (sample #1), in a conventional microwavable container (sample #2) and in a microwavable container constructed in accordance with the present invention as shown in FIGS. 1 to 5 (sample #3). Sample #1 was cooked in a conventional oven for 75 minutes. Samples #2 and #3 were exposed to microwave energy for 20 minutes. The pie top, side walls and bottom of each sample were evaluated. The temperature profiles of the cooked samples were also determined.

The results obtained are set forth in FIGS. 11*a* to 11*c*. It will be seen from these Figures that by employing the microwavable container structure of the present invention and especially that illustrated in FIGS. 1 to 5, the core temperature of the cooked sample is significantly increased as compared to sample #2 cooked in a microwave oven for a similar duration. The pie crust was also dry and browned unlike sample #2. The only comparable sample was sample #1 but that sample required a total preparation time of 90 minutes, 15 minutes to prewarm the oven and 75 minutes to cook the sample, a significantly longer duration.

SUMMARY

As those of skill in the art will appreciate, the present invention provides for a novel microwavable container for food products and specifically pies which generally uniformly heats the pie while browning and drying the pie crust. Those will also appreciate that variations and modifications may be made to the present invention without departing from the scope thereof as defined by the appended claims.

We claim:

1. A microwavable container comprising:

an outer sleeve;

an inner tray within said sleeve, said inner tray having a bottom wall and at least one upstanding side wall about the periphery of said bottom wall;

a first active microwave energy heating element within said sleeve, said first active microwave energy beating element disposed opposite a food product carried by said tray; and a second active microwave energy heating element on said tray, said second active microwave energy heating element having patterns of microwave energy interactive material on said bottom and side walls, wherein said first and second active microwave energy heating elements cooperatively control transmission of incident microwave energy towards a central region of said food product, while promoting browning of an outer surface of said food product.

2. A microwavable container as defined in claim 1 wherein the microwave energy interactive material on said side walls has a plurality of slots formed therein.

3. A microwavable container as defined in claim 2 wherein the slots adjacent the corners of said tray are curved to enhance browning of the food product in the corner regions of said tray.

4. A microwavable container as defined in claim 3 wherein opposed ends of at least some of said slots are bulbous.

5. A microwavable container as defined in claim 4 further comprising at least one layer of suscepting material on said at least one upstanding side wall and overlying said microwave energy interactive material.

6. A microwavable container as defined in claim 5 further comprising at least one layer of suscepting material on said bottom wall and overlying said microwave energy interactive material.

7. A microwavable container as defined in claim 2 wherein said elongate slots are arranged in rows.

8. A microwavable container as defined in claim 7 wherein said rows of slots are staggered.

9. A microwavable container as defined in claim 8 further comprising at least one layer of suscepting material on said at least one upstanding side wall and overlying said microwave energy interactive material.

10. A microwavable container as defined in claim 9 further comprising at least one layer of suscepting material on said bottom wall and overlying said microwave energy interactive material.

11. A microwavable container as defined in claim 1 wherein said pattern of microwave energy interactive material on said bottom wall includes at least one meandering loop.

12. A microwavable container as defined in claim 11 wherein the length of said at least one meandering loop is approximately equal to an integer multiple of the effective wavelength of the incident microwave energy.

13. A microwavable container as defined in claim 12 wherein said pattern of microwave energy interactive material on said bottom wall further includes a ring about the peripheral edge of said bottom wall and wherein said at least one meandering loop is open, said loop being coupled to said ring by bridges.

14. A microwavable container as defined in claim 13 wherein said pattern of microwave energy interactive material on said bottom wall further includes a plurality of spaced loops and islands.

15. A microwavable container as defined in claim 1 wherein said first active microwave energy heating element includes a pattern of microwave energy interactive material, said pattern including a ring about the periphery of said microwave energy heating element and defining a centrally located aperture.

16. A microwavable container as defined in claim 15 wherein said pattern of microwave energy interactive material further includes an array of microwave energy interactive elements within said aperture.

17. A microwavable container as defined in claim 16 wherein said microwave energy interactive elements are in the form of circular or hexagonal islands.

18. A microwavable container as defined in claim 16 wherein said microwave energy interactive elements are in the form of loops, each of said loops surrounding an island.

19. A microwavable container as defined in claim 1 wherein said pattern of microwave energy interactive material on said bottom wall includes a peripheral ring and centrally positioned, concentric octagonal rings coupled to said peripheral ring by bridges.

20. A microwavable container as defined in claim 19 wherein said concentric octagonal rings are coupled by pairs of diverging bridges.

21. A tray for a microwavable container comprising:

a bottom wall;

at least one upstanding side wall about a periphery of said bottom wall; and an active microwave energy heating element within said tray, said active microwave energy heating element having patterns of microwave energy interactive material on the bottom wall and the at least one upstanding side wall of said tray, said patterns configured to control transmission of incident microwave energy towards a central region of a food product carried by said tray, and further configured to brown an outer surface of said food product, wherein said pattern of microwave energy interactive material on said bottom wall includes at least one meandering loop, the length of which is approximately equal to an integer multiple of the effective wavelength of the incident microwave energy.

22. A microwavable container as defined in claim 21 wherein said pattern of microwave energy interactive material on said bottom wall further includes a ring about the peripheral edge of said bottom wall and wherein said at least one meandering loop is open, said loop being coupled to said ring by bridges.

23. A microwavable container as defined in claim 21 wherein said pattern of microwave energy interactive material on said bottom wall further includes a plurality of spaced loops and islands.

24. A microwavable container as defined in claim 21 wherein the microwave energy interactive material on said side walls has a plurality of slots formed therein.

25. A microwavable container as defined in claim 24 wherein the slots adjacent the corners of said tray are curved to enhance browning of said food product in the corner regions of said tray.

26. A microwavable container as defined in claim 25 wherein opposed ends of at least some of said slots are bulbous.

27. A microwavable container as defined in claim 26 further comprising at least one layer of suscepting material on said at least one upstanding side wall and overlying said microwave energy interactive material.

28. A microwavable container as defined in claim 27 further comprising at least one layer of suscepting material on said bottom wall and overlying said microwave energy interactive material.

29. An active microwave energy heating insert to be placed under a microwavable container comprising:

a substrate; and an active microwave energy heating element on an upper surface of said substrate, said active microwave energy heating element including a pattern of microwave energy interactive material, said pattern configured to control transmission of incident microwave energy towards a central region of a microwavable container supported on said insert, wherein said pattern of microwave energy interactive material includes at least one meandering loop, the length of which is approximately equal to an integer multiple of the effective wavelength of the incident microwave energy.

30. An active microwave energy heating insert as defined in claim 29 wherein said pattern of microwave energy interactive material further includes a ring about the peripheral edge of said substrate and wherein said at least one meandering loop is open, said loop being coupled to said ring by bridges.

31. An active microwave energy heating insert as defined in claim 29 further comprising at least one layer of suscepting material on said substrate and overlying said microwave energy interactive material.

* * * * *

UNITED STATES PATENT AND TRADEMARK OFFICE

CERTIFICATE OF CORRECTION

PATENT NO. : 6,150,646
APPLICATION NO. : 09/242893
DATED : November 21, 2000
INVENTOR(S) : Lai et al.

It is certified that error appears in the above-identified patent and that said Letters Patent is hereby corrected as shown below:

Claims 22-28 of the patent should be amended as follows:

Column 11 claim 22 after "A" insert -- tray for a --.
Column 11 claim 23 after "A" insert -- tray for a --.
Column 11 claim 24 after "A" insert -- tray for a --.
Column 11 claim 25 after "A" insert -- tray for a --.
Column 12 claim 26 after "A" insert -- tray for a --.
Column 12 claim 27 after "A" insert -- tray for a --.
Column 12 claim 28 after "A" insert -- tray for a --.

Signed and Sealed this

Twenty-second Day of December, 2009

David J. Kappos

David J. Kappos
*Director of the United States Patent and Trademark Office*

UNITED STATES PATENT AND TRADEMARK OFFICE

CERTIFICATE OF CORRECTION

PATENT NO. : 6,150,646
APPLICATION NO. : 09/242893
DATED : November 21, 2000
INVENTOR(S) : Lai et al.

It is certified that error appears in the above-identified patent and that said Letters Patent is hereby corrected as shown below:

Claims 22-28 of the patent should be amended as follows:

Column 11 claim 22 line 20, after "A" insert -- tray for a --.
Column 11 claim 23 line 26, after "A" insert -- tray for a --.
Column 11 claim 24 line 30, after "A" insert -- tray for a --.
Column 11 claim 25 line 33, after "A" insert -- tray for a --.
Column 12 claim 26 line 1, after "A" insert -- tray for a --.
Column 12 claim 27 line 4, after "A" insert -- tray for a --.
Column 12 claim 28 line 8, after "A" insert -- tray for a --.

This certificate supersedes the Certificate of Correction issued December 22, 2009.

Signed and Sealed this

Twelfth Day of January, 2010

David J. Kappos

David J. Kappos
*Director of the United States Patent and Trademark Office*